US011225817B2

(12) United States Patent
Evans

(10) Patent No.: US 11,225,817 B2
(45) Date of Patent: Jan. 18, 2022

(54) INTELLIGENT SENSING EDGE AND CONTROL SYSTEM

(71) Applicant: Rob J. Evans, Glendale, AZ (US)

(72) Inventor: Rob J. Evans, Glendale, AZ (US)

( * ) Notice: Subject to any disclaimer, the term of this patent is extended or adjusted under 35 U.S.C. 154(b) by 0 days.

(21) Appl. No.: 16/045,510

(22) Filed: Jul. 25, 2018

(65) Prior Publication Data

US 2019/0136601 A1 May 9, 2019

Related U.S. Application Data

(63) Continuation-in-part of application No. 16/011,498, filed on Jun. 18, 2018, and a continuation of application No. 15/188,935, filed on Jun. 21, 2016, now Pat. No. 10,000,958.

(51) Int. Cl.

| | |
|---|---|
| ***E05F 15/42*** | (2015.01) |
| ***E06B 9/68*** | (2006.01) |
| ***E06B 9/88*** | (2006.01) |
| ***E05F 15/72*** | (2015.01) |

(52) U.S. Cl.

CPC ..... *E05F 15/42* (2015.01); *E05F 15/72* (2015.01); *E06B 9/68* (2013.01); *E06B 9/88* (2013.01); *E05Y 2400/32* (2013.01); *E05Y 2400/44* (2013.01); *E05Y 2400/52* (2013.01); *E05Y 2900/106* (2013.01); *E05Y 2900/134* (2013.01); *E06B 2009/6836* (2013.01); *E06B 2009/885* (2013.01)

(58) Field of Classification Search

None

See application file for complete search history.

(56) References Cited

U.S. PATENT DOCUMENTS

| | | | | |
|---|---|---|---|---|
| 4,396,814 A * | 8/1983 | Miller | E05F 15/44 | 200/61.43 |
| 5,964,058 A * | 10/1999 | Richardson | E05F 15/44 | 49/27 |
| 6,396,010 B1 * | 5/2002 | Woodward | H01H 3/142 | 200/61.43 |
| 8,635,809 B2 * | 1/2014 | Wuerstlein | E05F 15/46 | 296/146.9 |
| 9,477,003 B2 * | 10/2016 | Pribisic | G01R 27/02 | |
| 2011/0128018 A1 * | 6/2011 | Reime | F16P 3/12 | 324/679 |

* cited by examiner

*Primary Examiner* — Marcus Menezes

(74) *Attorney, Agent, or Firm* — Morgan Law Offices, PLC

(57) ABSTRACT

A sensing edge is made in segments that can be used to determine at which point along the edge an obstruction occurred. Data collected can be used to determine a point in a process that the fault occurred by addressing each segment individually or as a whole. A programmable controller can be operatively coupled to the sensing edge, and can include logic to control the door and/or other equipment using data collected from the sensing edge.

7 Claims, 8 Drawing Sheets

INTELLIGENT SENSING EDGE AND CONTROL SYSTEM

CROSS-REFERENCE TO RELATED APPLICATIONS

This application is a continuation-in-part of Ser. No. 16/011,498, entitled "INTELLIGENT SENSING EDGE AND CONTROL SYSTEM" to Rob J. Evans, filed Jun. 18, 2018, which is a continuation of Ser. No. 15/188,935, entitled "INTELLIGENT SENSING EDGE AND CONTROL SYSTEM" to Rob J. Evans, filed Jun. 21, 2016, now U.S. Pat. No. 10,000,958, issued Jun. 19, 2018, which claims the benefit of provisional Ser. No. 62/330,791, filed May 2, 2016, the subject matter of each of the above incorporated herein by reference.

BACKGROUND

1. Field

The present invention relates to motorized doors, and, more particularly to an intelligent sensing edge and control system for a motorized door.

2. Description of the Related Art

Motorized doors have many industrial and commercial uses. However, care must be taken when operating a motorized door. When a motorized door encounters a significant obstruction during closing, for instance, it may be necessary to immediately reverse the motor direction or halt the operation of the door.

The prior art is replete with safety devices for motorized door systems, such as various types of safety edges. When a door is equipped with a safety edge, a signal is typically sent to halt or reverse the motor when the edge encounters an obstruction. In other cases, a signal is interrupted, and the absence of the signal then triggers the control system to take appropriate action.

In the prior art, pneumatic air activated systems include an edge having a flexible hose that is sealed. When encountering an obstruction, the hose is compressed causing the air in the hose to push against a switch, sending a signal to a control system. While such systems are useful, they often suffer from reliability and maintenance problems.

In the prior art, electric-activated edges are more widely employed. Typically, these devices include dual conductive strips that are separated by an air gap. When encountering an obstruction, the conductive strips are pushed together completing a circuit, thereby causing a signal to be sent to the control system.

Although such prior art safety edges are very useful, they suffer from the fact that they cannot provide any information other than the fact that the door has encountered an obstruction.

SUMMARY

A sensing edge is made in a plurality of segments that can be used to determine at which point along the edge an obstruction occurred. Data collected can be used to determine a segment of a sensing edge in a process that the fault occurred by addressing each segment individually or as a whole. A programmable controller can be operatively coupled to the sensing edge, and can include logic to control the door and/or other equipment using data collected from the sensing edge.

DETAILED DESCRIPTION

Figure 1:
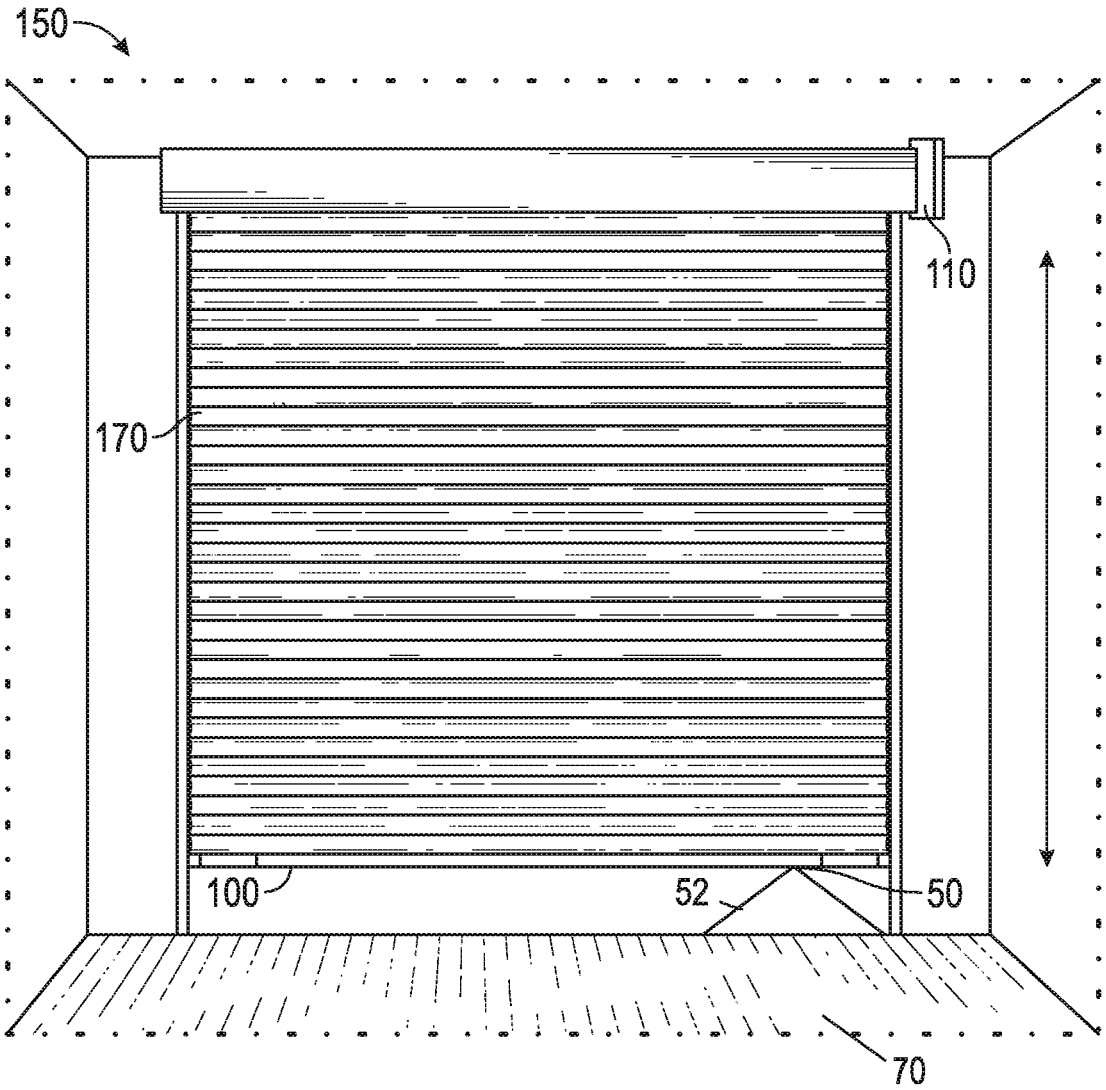
FIG. 1 illustrates an example overhead door having a sensing edge.

Referring to FIG. 1, an example overhead door system 150 having a sensing edge 100, according to an embodiment of the present invention, is illustrated. As shown, the overhead door system 150 includes a motorized gate 170 capable of upward and downward movement (as depicted by the up/down arrows). It is to be understood that the gate 170 will move in an upward direction when opening, and in a downward direction upon closing. It is further to be understood that various different types of motorized overhead doors exist, and the illustrated gate 170 is not meant to be limiting.

In various embodiments, the gate 170 is controlled by a controller 110 operatively coupled to an electric motor operating under the direction of the controller 110. In the illustrated embodiment, the controller 110 and the electric motor are housed together. However, in other embodiments, the controller is situated elsewhere. In some embodiments, the controller 110 is situated near or along the edge 100. The controller can include a "solid state" design or be a programmed PLC, for example. The controller is capable of storing data in storage 114.

Figure 5:
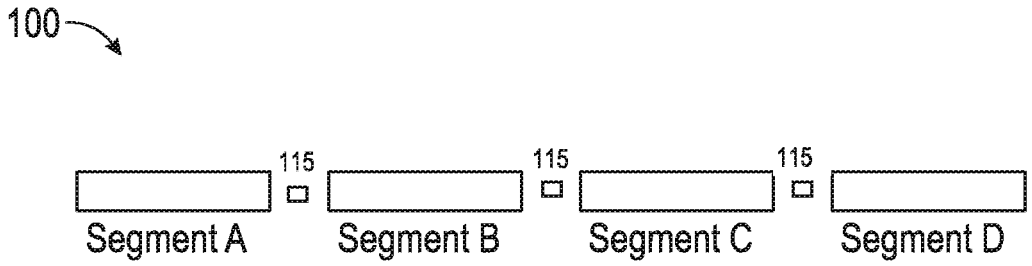
FIG. 5 illustrates a diagram showing that sensing edge divided into a plurality of segments.

In operation, when the gate 170 starts to close it may encounter an obstruction, such as the illustrated obstruction 52. The obstruction 52 could be any object, including a person, situated between the edge 100 and the ground 70 that would interfere with operation of the door system 150. As will be described in greater detail, upon encountering the obstruction 52, the sensing edge 100 senses the obstruction 52 at an impact point 50 and sends a signal to the controller 110 including data interpretable by the controller 110 as to both the existence of an obstruction 52 and a location along the edge 100 of the impact point 50. Although one impact point 50 is shown, it is to be understood that more than one impact point could exist, and the data transmitted to the controller 110 could include data as to the existence and location of additional impact points. Furthermore, in some embodiments, additional sensors, such as optical or thermal sensors 115 (as depicted in FIG. 5) can be included near or along the edge 100 (or elsewhere), and such additional sensor information could be provided to the controller 110, either along with or separately from the segment sensor data. In the case of a thermal sensor 115, such information could be useful in determining whether a fire exists. A fire door can then be closed, for example. However, if the controller 110 also determines using the segment sensors that the fire door is obstructed or compromised, the controller 110 can cause the fire door to close incrementally. That is, the door may close a few inches at a time and then stop, and repeat until it is fully closed. Alternative circuitry to accomplish this task may be provided. In this manner, a balance is maintained between keeping the fire door closed to limit the spread of the fire and not causing damage or injury, so as to allow a person in the path of or near the door to know that the door is in the process of closing.

Figure 2:
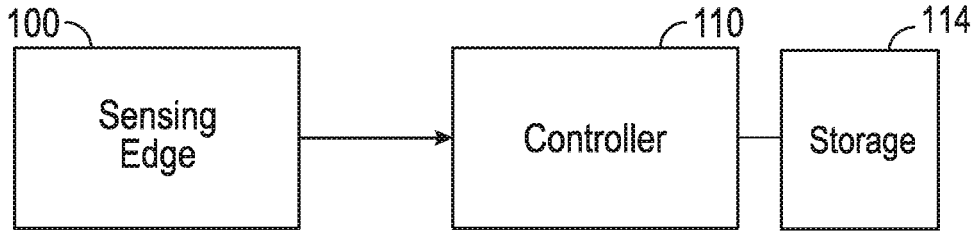
FIG. 2 illustrates a diagram showing the operational linkage between the sensing edge and a control system.

Referring to FIG. 2, a diagram showing the operational linkage between the sensing edge 100 and the controller 110 is provided. It is to be understood that instead of a wired connection between the sensing edge 100 and the controller 110, information can alternatively or additionally be transmitted via a wireless link. For example, in an embodiment, the sensing edge 100 includes a radio transmitter capable of transmitting data to a receiver operatively connected to the controller 110. In other embodiments, the sensing edge 100 includes a transceiver capable of receiving data from the controller 110 as well as transmitting data to the controller 110.

Figure 3:
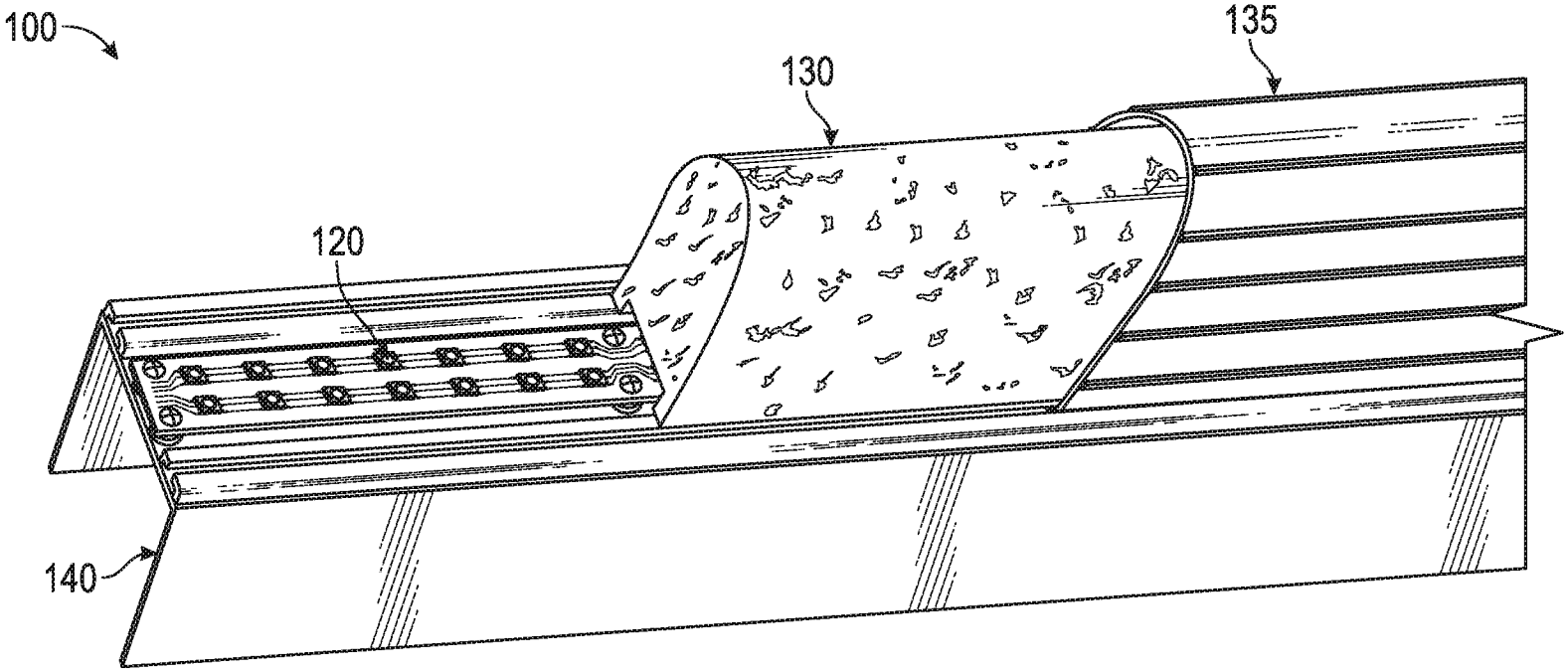
FIG. 3 illustrates a cutaway perspective view of an example sensing edge according to a first embodiment.

Referring to FIG. 3, a cutaway perspective view of an example sensing edge 100, according to an embodiment of the present invention, is illustrated. As illustrated, the sensing edge 100 includes a retainer 140, a safety board 120, a foam insert 130 and a weather strip 145. The retainer can be made of aluminum or a hard plastic, for example. As shown, the retainer 140 includes a top surface and opposing lateral sides disposed perpendicularly to the top surface forming a C-shaped strip. In an embodiment, the retainer 140 is about $1/8^{th}$ inch in thickness. The length of the retainer 140 can be any suitable size for the door.

It is to be understood that the bottom edge of the gate 170 fits between the pair of lateral sides, and the retainer 140 will be appropriately fastened to the edge of the gate using any suitable means, such as an adhesive, rivets, screws, etc. It is also to be understood that the retainer 140 can run the entire length of the edge. As shown, the safety board 120 is disposed on the top surface of the retainer 140. The safety edge 120 is encapsulated by the weather strip 135, which can be made of vinyl or another durable, flexible and weather-resistant material. The interior is filled with the foam insert 130 which can be a relatively hard foam or another suitable compressible material.

Figure 4:
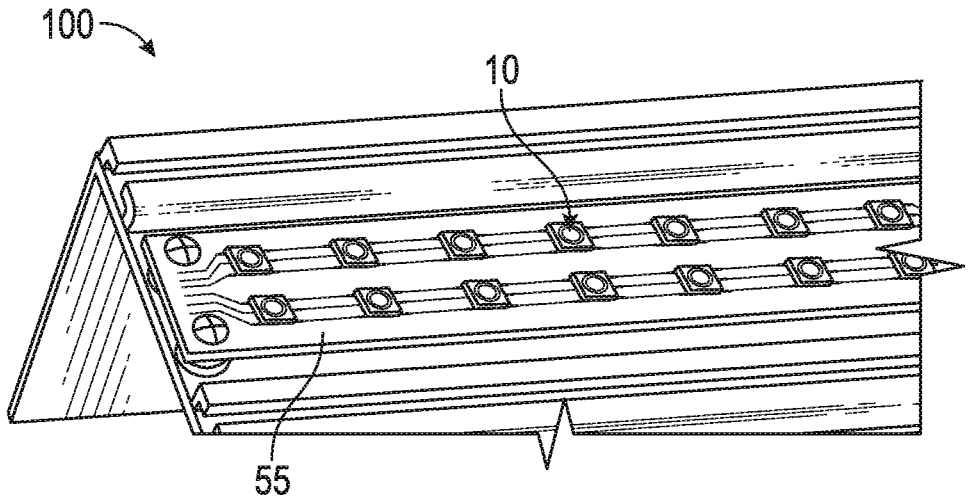
FIG. 4 illustrates a close-up view of the example sensing edge of FIG. 3.

Referring to FIG. 4, a close-up view of the exemplary sensing edge 100 is illustrated. As shown, the safety board 120 includes a substrate 55 that can be a printed circuit board (PCB) or the like running substantially entirely across the length of the edge. Disposed on the substrate 55 is a plurality of tactile sensors 10. Such tactile sensors are activated upon a sufficient force being applied thereto. In operation, when the edge 100 encounters an obstruction, the force from the impact will be transferred through the weather strip 135 and the foam insert 130 to one or more tactile sensor 10. In an embodiment, upon sufficient force, the affected sensors 10 will open a circuit (using "normally closed" sensors). In other embodiments, the force will close a circuit (using "normally open" sensors). In either case, the electrical wiring of the PCB board will be such that the location of the particular sensor 10 or group of sensors 10 can be determined. In the spirit of the invention, the substrate 55 can be achieved alternatively using a flexible circuit board, individual resistive elements, an arrangement of mechanical switches, photo sensors, or any segmental conductive element such as copper or aluminum or breadboard design, etc. Additionally, a trace circuit will preferably be included along the edge and connected to the controller 110. The trace circuit can be a normally closed circuit, and if the door is severely impacted (by an automobile, for example), the trace circuit would be open due to the damage. In this event, a door fault is detected by the controller 110, and the controller 110 would take appropriate action such as instruct the door motor to be shut off. The trace additionally can have an alarm so that if an intruder pries the door open (or attempts to do so) using a crow bar or the like, it would compromise the trace and thus initiate a burglar alarm.

Referring to FIG. 5, the sensing edge 100 is shown divided into addressable segments A-D. It is to be understood that while four segments (A-D) are shown, either a greater or fewer number of segments could be provided. Furthermore, in the illustrated embodiment, each segment is addressable. However, in other embodiments, individual tactile sensors 10 could be addressable.

It is to be understood that each of the segments A-D shown includes a group of contiguous tactile sensors 10 such that when any sensor in the segment is activated, the affected segment can be determined by information sent to the controller 110. In an embodiment, each segment A-D includes fourteen tactile sensors 10 arranged as seven pairs of sensors.

In an embodiment, the segments A-D are each electrically isolated. In an embodiment, each Segment A-D can include its own segment transmitter, and each segment transmitter can be operatively coupled to the controller 110. The same effect can be achieved by hard wiring each segment to a single transmitter operatively coupled to the controller 110 or hard wiring each segment to the controller 110. In other embodiments, the segments A-D are connected electrically, but each of the affected segments is individually addressable. In still other embodiments, multiple sensing edges 100 affixed to a plurality of doors are operatively coupled to a single controller 110 that is configured to control each of the doors in case of issues with the doors. In such case, each door would be assigned an identifier and each segment assigned another identifier, according to an agreed upon addressing scheme. In various embodiments, the controller 110 is disposed on the sensing edge 100 (e.g., on the PCB). In other embodiments, the controller 110 is located remotely but operatively coupled to the sensing edge 100.

In various embodiments, the controller 110 includes a CPU that can be configured (e.g., programmed) to take action based on inputs received from the sensing edge 100. The controller 110 could be a programmable logic controller (PLC) or the like, and the inputs could be a sequence of data from the sensing edge 100, for example. Additionally, the controller 110 can include a time/date module to time/date stamp received inputs and record associated actions taken. The controller 110 can further include storage 114 to store this information.

Figure 6:
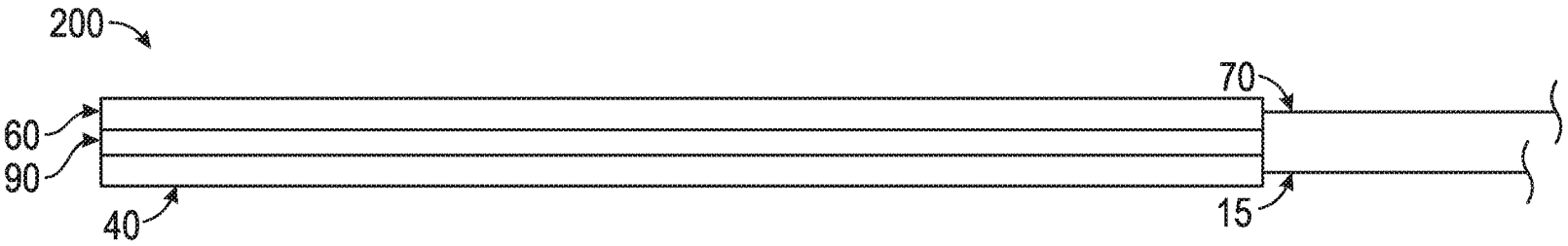
FIG. 6 illustrates a side view of an example sensing edge according to a second embodiment.

Referring to FIG. 6, a side view of an exemplary sensing edge 200, according to another embodiment, is illustrated. The sensing edge 200 is similar in function to the sensing edge 100, the main difference being that the sensing edge 200 employs a structure using conductive ink technology, as discussed below.

As shown in FIG. 6, the sensing edge 200 includes a segment retainer 60, an isolating insert 90, and a grounding retainer 40. The isolating insert 90 is made of an insulative material and is sandwiched between the segment retainer 60 and the grounding retainer 40.

Figure 7:
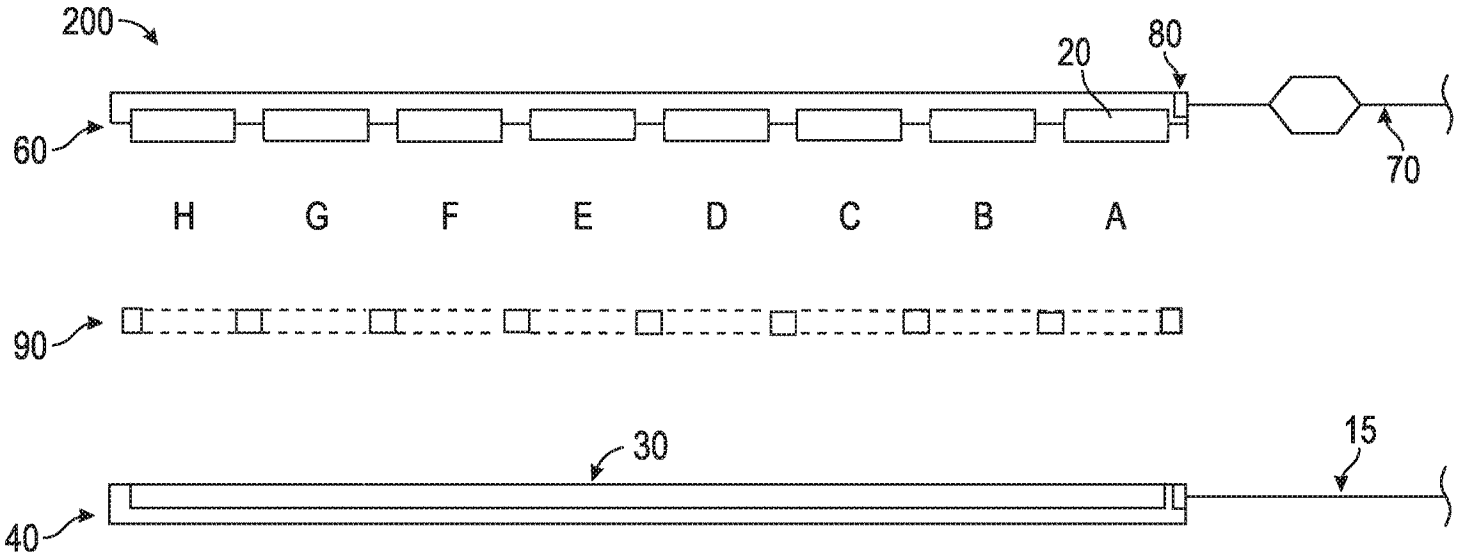
FIG. 7 illustrates a cutaway side view of the sensing edge of the example sensing edge of FIG. 6.

FIG. 7 shows an exploded cutaway view of the sensing edge 200. As depicted, the segment retainer 60 includes a plurality of segment substrates 20 each imprinted with conductive ink. Grounding retainer 40 has a continuous conductive grounding substrate 30 throughout its length, also formed and imprinted with conductive ink. Conductive ink results in a substrate that conducts electricity. Conductive inks are made by infusing graphite or other conductive materials such as nanoparticles of one or more metals (e.g., silver, gold, copper) in ink.

Each segment substrate 20 is electrically isolated, and a connector 80 is used to mate each of the segment substrates 20 with individual wire conductors of a multi-conductor cable 70 or the like. Each wire conductor is thereby electrically connected to an individual segment substrate 20. These wire conductors can be connected to the controller 110 (as shown in FIG. 2). Additionally, the grounding substrate 30 is connected to a connector 85, mating the grounding substrate 30 to a ground wire 15 further connected to controller 110. A continuity circuit is completed when the grounding substrate 30 is touched to any of the segment substrates 20 of the segment retainer 60, sending an individual continuity signal from each affected substrate 20 to the controller 110. The segment retainer 60 can be made of hard foam or a hard plastic, for example. The grounding retainer 40 and isolating insert 90 are made of relatively hard foam or another suitable compressible material. The length of the sensing edge 200 can be any suitable size for the door edge. It is to be understood that the sensing edge 200 will be appropriately fastened to the edge of the gate using any suitable means, such as an adhesive, rivets, screws, etc., with the grounding retainer 40 arranged at the bottom of the structure facing the floor. Further, an appropriate weather strip may be used to cover the sensing edge 200.

The isolating insert 90 has openings 95 corresponding to each segment substrate 20. In operation, when the grounding retainer 40 encounters an obstruction, the force from the impact will be transferred through one or more segment opening 95 of the isolating insert 90 to corresponding one or more segment substrate 20, thereby touching the grounding substrate 30 to one or more of the segment substrates 20 completing one or more continuity circuit to controller 110. The location and extent of the impact can be noted (and time stamped) at controller 110 by one or more segment substrates 20 touched by grounding substrate 30.

Figure 8:
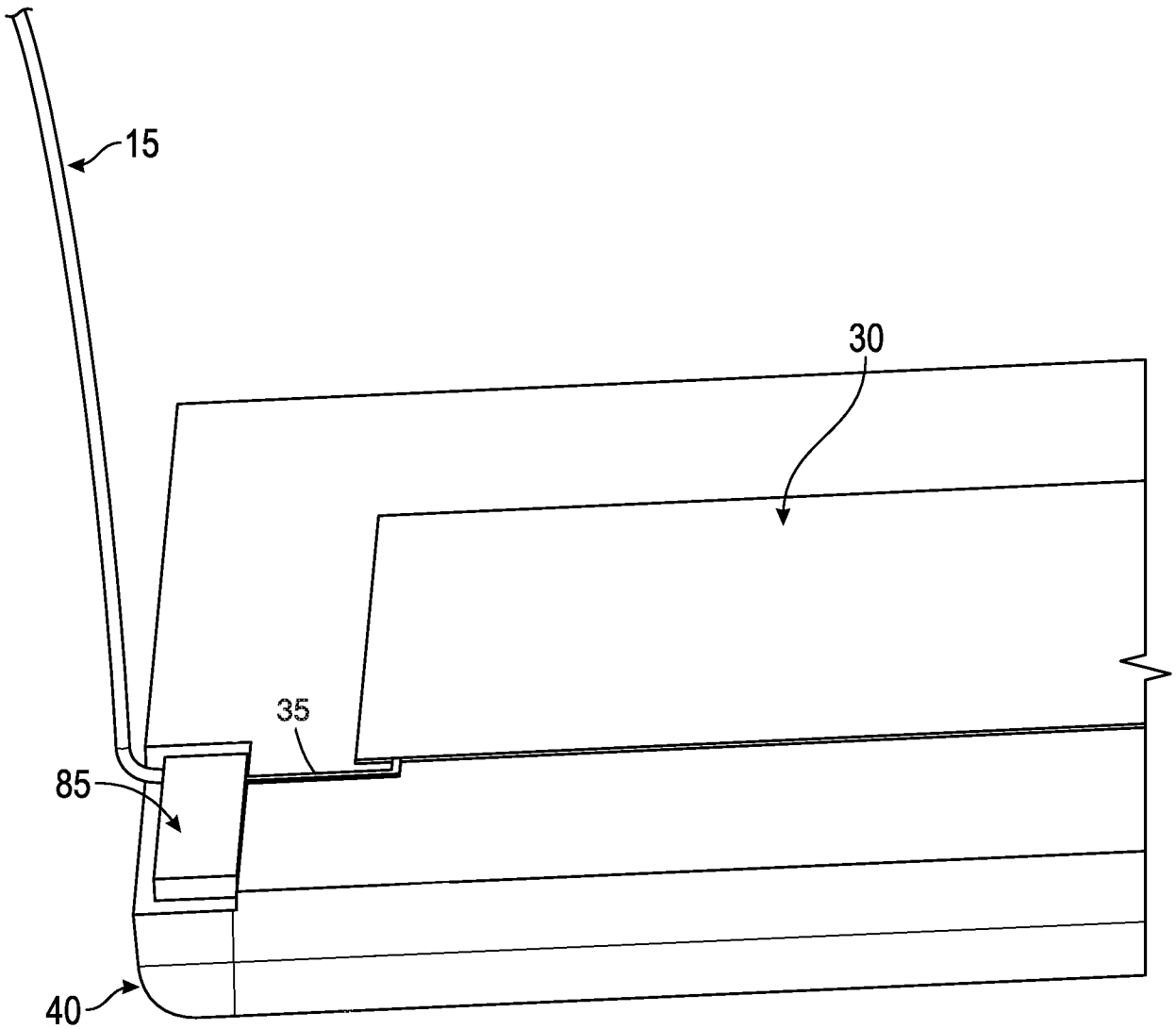
FIG. 8 illustrates a close-up view of the grounding retainer of the sensing edge.

Referring to FIG. 8, a close-up view of the grounding retainer 40 is shown with grounding substrate 30 connected by a conductive trace 35 to the connector 85. Conductive trace 35 is further connected to ground wire 15. Ground wire 15 is further connected to controller 110.

Figure 9:
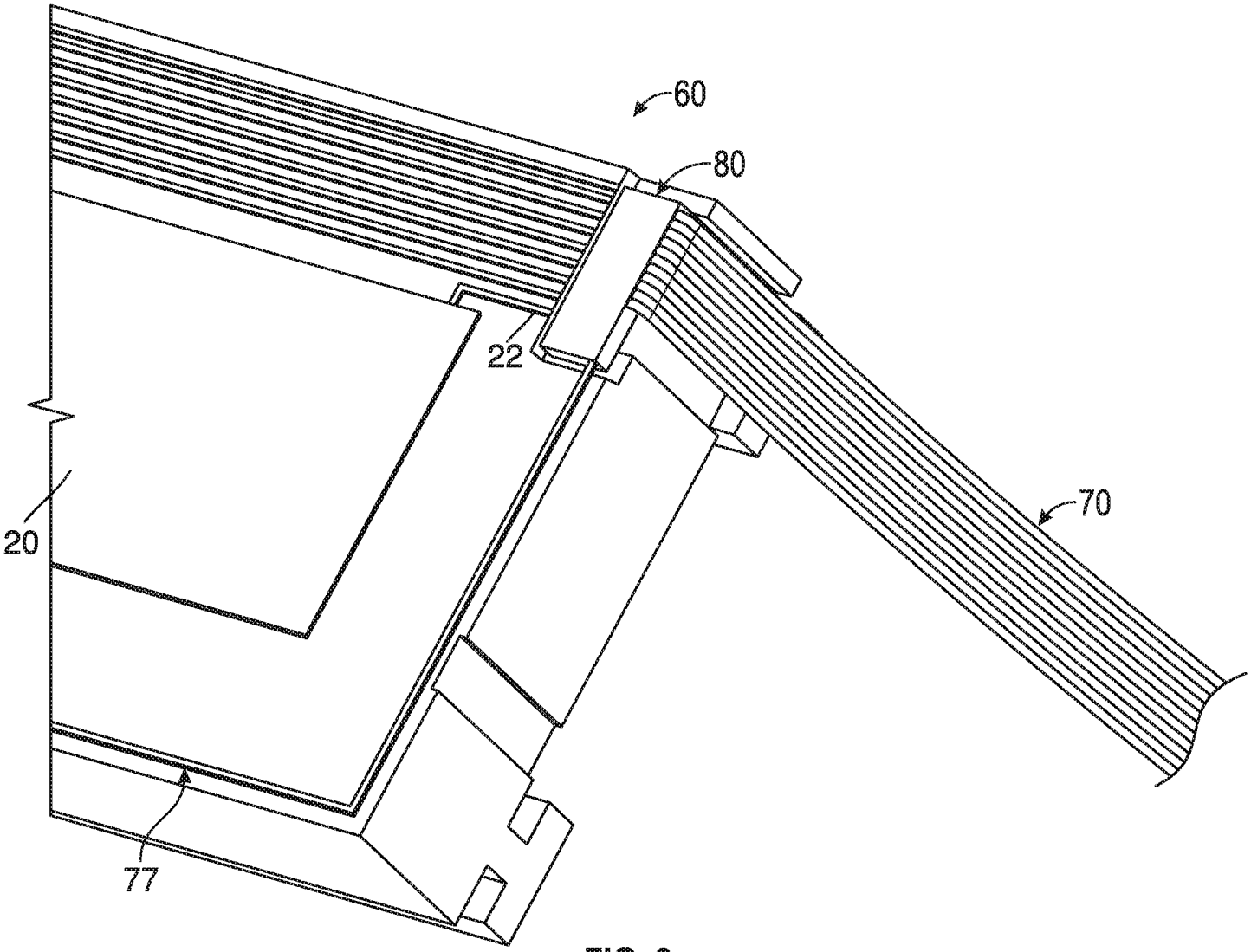
FIG. 9 illustrates a close-up view of the segment retainer of the sensing edge.

Turning now to FIG. 9, a close-up view of a part of segment retainer 60 is illustrated. As shown, segment 20 (corresponding to segment A, FIG. 5) is electrically connected to connector 80 via conductive trace 22. In turn, the connector 80 is electrically connected to multi-conductor cable 70.

Accordingly, a conductive path can be formed from segment substrate 20 (corresponding to segment A) through conductive trace 22, connector 80, and one of the wires in the multi-conductor cable 70 leading eventually to controller 110. Additionally, the segment retainer 60 can include a trace circuit 77. The trace circuit 77 can be disposed along the perimeter of the bottom surface of the segment retainer 60. The trace circuit 77 is connected to the connector 80 and mated to an individual wire conductor of the multi-conductor cable 70. The trace circuit can be a normally closed circuit, and if the door were severely impacted (by an automobile, for example), the trace circuit would be open due to the damage. In this event, the controller 110 detects a door fault, and the controller 110 would take appropriate action such as instruct the door motor to be shut off. The trace circuit additionally can have an alarm so that if an intruder pries the door open (or attempts to do so), it would compromise the trace and thus initiate a burglar alarm.

Figure 10:
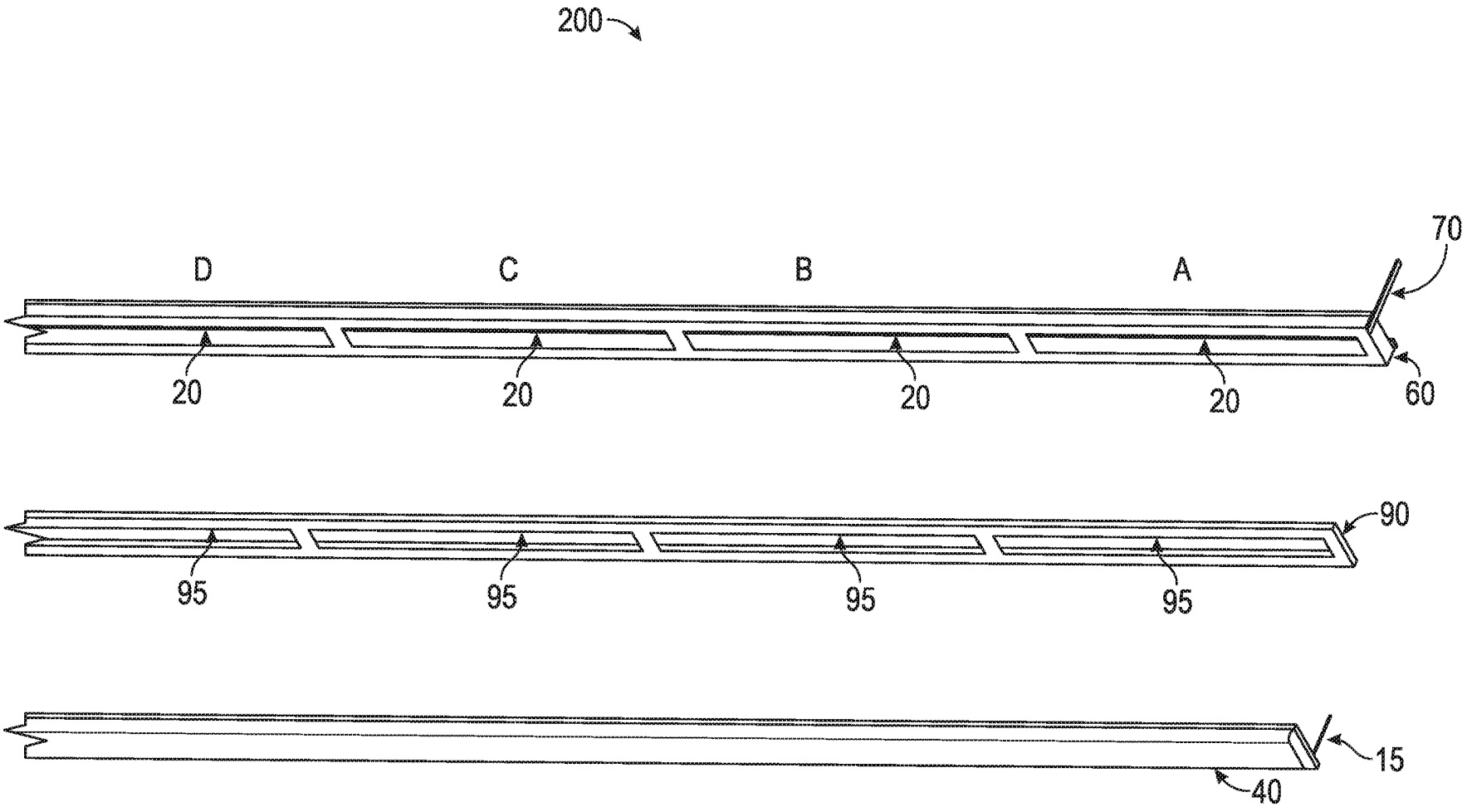
FIG. 10 illustrates an exploded partial view of a sensing edge.

FIG. 10 illustrates an exploded partial view of the sensing edge 200. As depicted, the isolating insert 90 includes a plurality of openings 95 corresponding to segment segments 20 (labeled individually as segments A-D). The grounding retainer 40 with its ground wire 15 and the segment retainer 60, shown with connector 80 and multi-conductor cable 70, is also illustrated.

Figure 11:
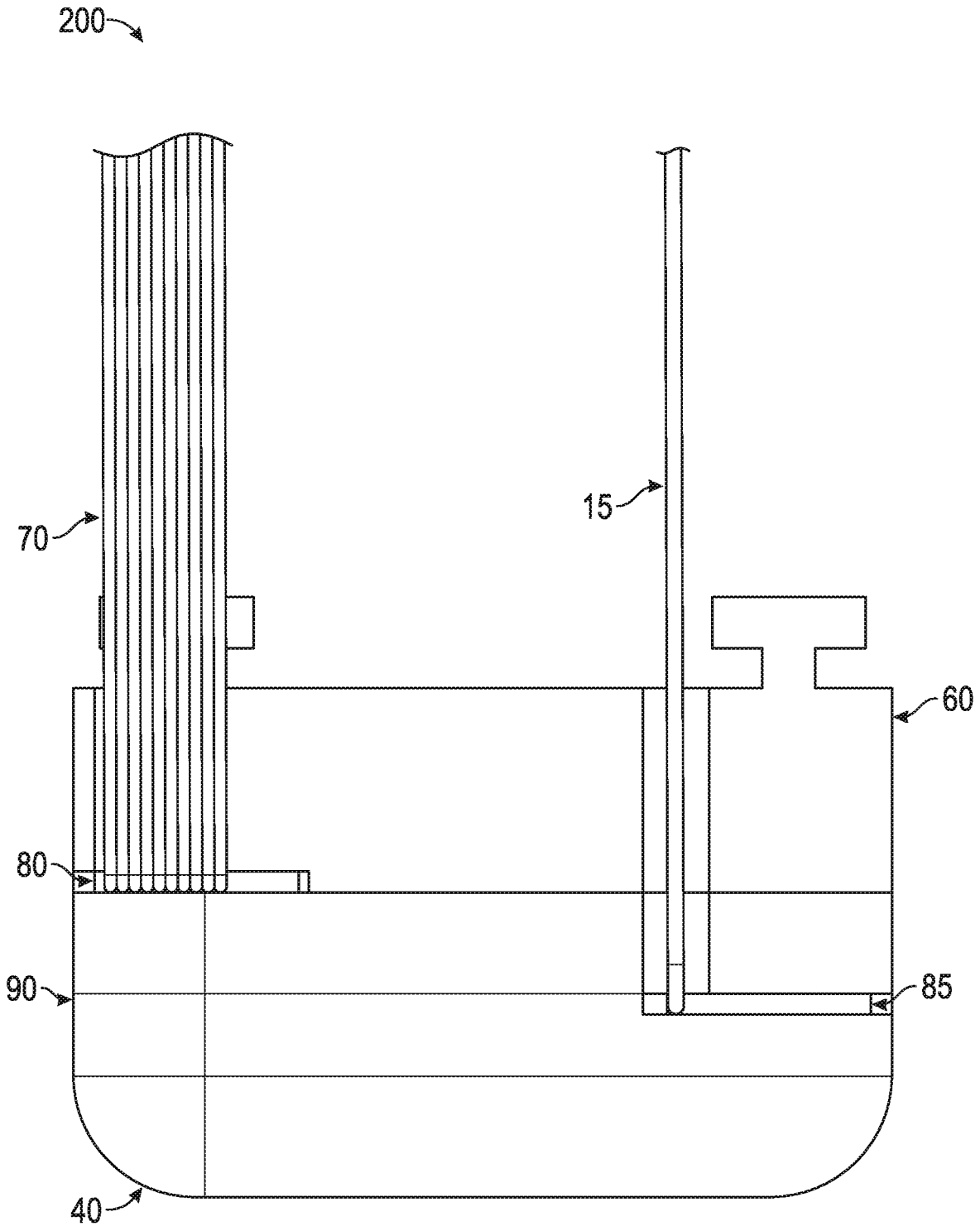
FIG. 11 illustrates a side view along the width of the sensing edge.

Referring to FIG. 11, the sensing edge 200 is shown from a side along its width.

As with the sensing edge 100, the sensing edge 200 can be used to determine the location along the edge of an impact. Instead of hard wiring, each segment can include its own segment transmitter, and each segment transmitter can be operatively coupled to the controller 110. The same effect can be achieved by forming conductive traces from each segment to a single transmitter operatively coupled to the controller 110. In some embodiments, multiple sensing edges 200 (and/or sensing edges 100) can be affixed to a plurality of doors, and operatively coupled to a single controller 110 that is configured to control each of the doors in case of issues with the doors. In such case, each door could be assigned an identifier and each segment of each door could further be assigned an identifier, according to an agreed-upon addressing scheme. In various embodiments, the controller 110 is disposed in close proximity or on the sensing edge 200. In other embodiments, the controller 110 is located remotely but operatively coupled to the sensing edge 200.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A safety edge system, comprising a safety edge including a segment retainer, a grounding retainer, and an isolating insert disposed between the segment retainer and the grounding retainer;

wherein the segment retainer includes a plurality of segment substrates arranged longitudinally across the segment retainer, each segment substrate is imprinted with conductive ink and connected to a conductive wire;

wherein the grounding retainer includes a continuous surface imprinted with conductive ink; and wherein the isolating insert includes a plurality of openings corresponding to the segment substrates, forming air gaps between the segment retainer and the grounding retainer; and a controller operatively connected to the segment substrates, wherein, responsive to application of a force through the grounding retainer and the isolating insert, the controller is able to identify a location along the length of the safety edge where the force was applied; and wherein conductive traces are imprinted individually to each segment substrate connecting the segment substrates to a connector with a multi-conductor cable, said connector further connecting the conductive traces to individual wire conductors, said wire conductors connecting to the controller.

2. The safety edge system of claim 1, wherein the controller time stamps data regarding operation of the safety edge, the time stamped data is stored on a storage medium.

3. The safety edge system of claim 2, wherein the safety edge is capable of attachment to an edge of a motorized gate.

4. The safety edge system of claim 1, wherein each of the segment substrates are separately identifiable.

5. The safety edge system of claim 1, wherein the controller causes at least one gate to incrementally close when at least one thermal sensor is activated and an obstruction is detected based upon data received from one or more of the segment substrates.

6. The safety edge system of claim 1, wherein the segment retainer includes a closed circuit, and when force is applied to one or more of the segment substrates electrically connected to the circuit, the circuit is opened thereby signaling a fault.

7. The safety edge system of claim 1, wherein the segment retainer includes an open circuit, and when force is applied to one or more of the segment substrates electrically connected to the circuit, the circuit is closed thereby signaling a fault.

* * * * *